US008945457B2

(12) United States Patent
Lehto

(10) Patent No.: US 8,945,457 B2
(45) Date of Patent: Feb. 3, 2015

(54) METHOD AND SYSTEM FOR CREATING AN APERTURED WEB-SHAPED MATERIAL

(75) Inventor: Marcus Lehto, Mölndal (SE)

(73) Assignee: SCA Hygiene Products AB, Gothenburg (SE)

( * ) Notice: Subject to any disclaimer, the term of this patent is extended or adjusted under 35 U.S.C. 154(b) by 251 days.

(21) Appl. No.: 13/265,920

(22) PCT Filed: Apr. 27, 2009

(86) PCT No.: PCT/SE2009/050435
§ 371 (c)(1),
(2), (4) Date: Oct. 24, 2011

(87) PCT Pub. No.: WO2010/126406
PCT Pub. Date: Nov. 4, 2010

(65) Prior Publication Data
US 2012/0038088 A1 Feb. 16, 2012

(51) Int. Cl.

| | |
|---|---|
| ***B06B 1/02*** | (2006.01) |
| ***B26F 1/26*** | (2006.01) |
| ***B26D 7/08*** | (2006.01) |
| ***B26F 1/00*** | (2006.01) |

(52) U.S. Cl.
CPC . *B26F 1/26* (2013.01); *B26D 7/086* (2013.01); *B26F 1/00* (2013.01)
USPC ..... 264/444

(58) Field of Classification Search
USPC ..... 264/444
See application file for complete search history.

(56) References Cited

U.S. PATENT DOCUMENTS

| | | | | |
|---|---|---|---|---|
| 3,949,127 | A * | 4/1976 | Ostermeier et al. | 428/137 |
| RE33,063 | E | 9/1989 | Obeda | |
| 5,733,411 | A * | 3/1998 | Bett | 156/580.2 |
| 5,871,605 | A | 2/1999 | Bett | |
| 6,123,792 | A | 9/2000 | Samida et al. | |

(Continued)

FOREIGN PATENT DOCUMENTS

| | | |
|---|---|---|
| CN | 101365577 A | 2/2009 |
| EP | 0 457 187 | 3/2000 |

(Continued)

OTHER PUBLICATIONS

Colombian Office Action dated Aug. 20, 2013 from corresponding Colombia patent application No. 11161979 (with its English-language translation) (27 pages).

(Continued)

*Primary Examiner* — Larry Thrower
(74) *Attorney, Agent, or Firm* — Drinker Biddle & Reath LLP

(57) ABSTRACT

A method for creating apertures with melted edges in a web shaped material including feeding a web-shaped material through a nip between a rotational ultrasonic horn and a rotational anvil roller, so as to create melted regions in the web-shaped material, while the web is residing on the anvil roller having a rotational speed. The method further includes controlling the rotational speed of the ultrasonic horn to a speed other than that of the anvil roller, such that a speed difference is created between the horn and the anvil roller. The speed difference is selected such that a stress created in the web acts to rupture the centers of the melted regions in the web-shaped material, whereby the apertures with melted edges are created.

10 Claims, 2 Drawing Sheets

(56) References Cited

U.S. PATENT DOCUMENTS

| | | | |
|---|---|---|---|
| 7,690,548 | B2 | 4/2010 | Mlinar et al. |
| 2005/0136772 | A1 | 6/2005 | Chen et al. |
| 2009/0133803 | A1 | 5/2009 | Lehto |

FOREIGN PATENT DOCUMENTS

| | | | |
|---|---|---|---|
| ES | 2175169 | | 11/2002 |
| JP | 2008526514 | | 7/2008 |
| JP | 2008260131 | | 10/2008 |
| WO | WO-0009314 | A1 | 2/2000 |
| WO | 2004/089612 | | 10/2004 |
| WO | WO-2007/094706 | | 8/2007 |

OTHER PUBLICATIONS

Chinese Office Action dated Jul. 31, 2013 from corresponding Chinese patent application No. 200980158676.0 (English translation only) (5 pages).

Shvartso et al, "Plastic processing", St. Petersburg, 2005, pp. 272-273, 290-291.

Decision on Grant from corresponding Russian patent application No. 2011148102 dated Feb. 22, 2013 (and its English translation).

* cited by examiner

METHOD AND SYSTEM FOR CREATING AN APERTURED WEB-SHAPED MATERIAL

CROSS-REFERENCE TO PRIOR APPLICATION

This application is a §371 National Stage Application of PCT International Application No. PCT/SE2009/050435 filed Apr. 27, 2009, which is incorporated herein in its entirety.

TECHNICAL FIELD

The present disclosure relates to a method and a system for creating apertures with melted edges in a web shaped material including: feeding a web-shaped material through a nip between a rotational ultrasonic horn and a rotational anvil roller, so as to create melted regions in the web-shaped material, while the web is residing on the anvil roller having a rotational speed.

BACKGROUND

Apertured surface materials are often used in disposable personal care products such as diapers, sanitary napkins, or the like. The apertured materials could be used e.g. as topsheets, as intermediate layers in the products or at the edges thereof.

For certain applications it is desired to have apertured web-shaped materials with sealed edges. For instance, this could be the case for materials that are to be used as topsheets or acquisition layers in absorbent products. The edges being sealed ensures that any liquid received on the topsheet passes through the apertures without being absorbed via the edges of the apertures.

The application of apertured materials is however not limited to materials intended to allow liquid to pass therethrough. For example, apertured materials could also be absorbent, having apertures so as to allow the materials to breathe.

Known processes for forming apertured web-shaped materials with sealed edges include thermobonding followed by aperturing the regions of the thermobond, needling, mechanical cutting, laser cutting, water jet cutting, etc.

Usually, the apertured materials are acquired separately and brought to a product manufacturing process where they are bound to form a product, such as a disposable personal care product. Accordingly, the manufacturer of absorbent products must order and stock sufficient amounts of apertured materials, and have limited capability of adjusting the acquired apertured materials to the needs e.g. of new products.

Alternatively, the product manufacturer may have their own aperturing equipment, although the aperturing equipment is then separate from the equipment for forming the complete absorbent product.

SUMMARY

In view of the above, it is desired to provide a method for creating an apertured web material which is suitable for inclusion in an in-line manufacturing process of a personal care product. To this end, the method should be applicable to different line speeds, as may be required for the manufacture of different types of personal care products.

Moreover, regardless of whether the apertured surface material is created in an in-line process or not, there is generally a need for providing apertured surface materials in a cost-efficient and quick manner.

There is also a need for providing apertured laminated surface materials in a cost-efficient and quick manner.

It is desired to provide a method for creating an apertured web with sealed edges, which is advantageous in view of one or more of the above-mentioned aspects.

The above can be achieved by a method for creating apertures with sealed edges in a web shaped material including:

feeding a web-shaped material through a nip between a rotational ultrasonic horn and a rotational anvil roller, so as to create melted regions in said web-shaped material, while the web is residing on the anvil roller having a rotational speed, and controlling the rotational speed of the ultrasonic horn to a speed other than that of the anvil roller, such that a speed difference is created between the horn and the anvil roller, the speed difference being selected such that the stress created in the web acts to rupture the centers of the melted regions in the web-shaped material, whereby apertures with melted edges are created.

A method as described above has the advantage of being susceptible to inclusion in an in-line process for manufacturing an absorbent product. As the method relies on control of a speed difference between the horn and the roller, the method may be used in a wide range of anvil roller speeds, and may easily be adapted to the requirements of an in-line process.

The method utilizes the stress created in the web by the speed difference between the ultrasonic horn and the anvil roller to create apertures. Simply put, the ultrasonic energy will create melted regions in the web-shaped material, which are relatively brittle. As the web is affected by the stress created by the speed difference, the brittle centers of the regions will rupture. However, the edges of the melted regions will remain intact. Accordingly, apertures having melted edges are created.

That regions being melted by ultrasonic technology may unintentionally rupture has been known in the past. However, this process has been regarded as a randomly occurring fault which is to be avoided when e.g. forming ultrasonically laminated products.

The present disclosure aims to provide a reliable and controllable method for deliberately producing apertures with melted edges in a web material, which is clearly different than such apertures occurring randomly as a fault in a process e.g. for lamination.

In particular, the speed difference is actively controlled and selected so as to purposely arrive at the desired apertures with melted edges.

The production of apertures could be made continuously over a web area or intermittently, e.g. in selected regions of the web area.

The versatility of the ultrasonic welding technology in combination with the advantage that the proposed method is suitable for a wide range of manufacturing speeds, including such that are used for in-line manufacturing of absorbent articles, make the proposed method particularly suitable for including in a production line for in-line manufacturing of articles. When the method is implemented in this context, the manufacturer is only required to purchase and stock standard, un-apertured web material, to be used in the in-line manufacturing process. Via the proposed method, the standard web materials may be provided with selected apertures in-line, the apertures being suitably adapted to the needs of the absorbent product which is manufactured in the in-line process.

Advantageously, the nip may be a non-contact nip. This can be desired since use of a non-contact nip results in reduced wear of the components involved. However, the method per se is not restricted to non-contact nips, but may be used also in a contact nip.

In particular embodiments, the rotational speed of the horn may be controlled in relationship to the speed of the anvil roller, so as to maintain a controlled speed difference regardless of the speed of the anvil roller. This provides a particularly adaptive system, where the speed of the process as a whole may be varied substantially without affecting the creation of the apertures. This is particularly beneficial when the method is to be included in an in-line product manufacturing process, as the speed of the complete manufacturing line may need to be varied for different purposes concerning different manufacturing steps in the procedure.

Advantageously, the web-shaped material may include at least two separate plies, which are fed through the non-contact nip such that the at least two plies are laminated together via the melted edges of the apertures. In this case, the web-shaped material is laminated and apertured in a one-step procedure. This provides a simple and robust process for creating laminated, perforated plies, which moreover provides lamination and apertures in perfect register.

The web-shaped material may include any number of plies, for example at least 4, in particular at least 6 separate plies which are laminated together via the melted edges of the apertures. The proposed method is believed to be able to laminate and perforate a relatively large number of plies, as long as the thickness of the plies is such that the supplied ultrasonic energy is properly transmitted through all of them so as to melt the material therein.

In particular embodiments, the rotational speed of the horn is other than 0, e.g. the horn is indeed intended to rotate.

Advantageously, the difference in rotational speed between the anvil roller and the horn in relation to the rotational speed of the anvil roller ((speed roller−speed horn)/speed roller) is in the range ±10-100%, in particular ±10-90%, most particularly ±30-90% of the speed of the anvil roller.

The anvil roller and the horn may rotate in the same direction or in different directions. If they rotate in different directions, it is understood that the speed difference between them is calculated as the true relative speed difference, using the anvil roller direction as the positive direction. If e.g. the anvil roller rotates clockwise, a clockwise rotation will be positive, and if the horn rotates counter-clockwise, the counter-clockwise rotation will be negative. Accordingly, speed roller−speed horn will give the true difference in rotational speed.

The above-mentioned speed differences are believed to be particularly suitable for creation of the desired apertures.

Advantageously, the difference in rotational speed between the anvil roller and the horn is in the range 20-300 m/min, in particular in the range 25 to 250 m/min, most particularly in the range 100 to 250 m/min.

Advantageously, the rotational speed of the horn is in the range 5-500 m/min, in particular 50-450 m/min.

In particular embodiments, the total surface weight of the web-shaped material is between 10 gsm and 300 gsm.

The web-shaped materials could be any materials susceptible to ultrasonic welding. In a particular embodiment, such a material may include a thermofusible material.

However, when multi-ply web shaped materials are formed as a result of the method (i.e. lamination takes place), it is understood that all plies need not include meltable material. Instead, it is sufficient that there is at least one ply which includes a material which does melt, whereby the desired lamination may be accomplished. For example, a non-melting ply may be sandwiched between two melting plies, and subject to the method for creating apertures with sealed edges. The method will then result in a multi-ply web where all three plies are laminated together along the sealed edges of the apertures.

In a particular embodiment, the web-shaped material includes at least one ply of a nonwoven material. Nonwoven materials are fibrous materials including either homogenous or mixed fibers. In particular embodiments, some or all of the fibers may include polyolefins, e.g. polymer materials such as polyethylene and polypropylene, or alternatively materials made out of polyester, nylon or the like.

Alternatively, or in addition to the non-woven material, the web-shaped material may include at least one ply of a film material. Suitable films may be films of thermoplastic materials, e.g. polyethylene or polypropylene.

The web-shaped material may also include at least one ply being in the form of materials made from natural fibers such as wood or cotton fibers, foam material or other materials that are capable of being welded using ultrasonic technology.

With the proposed method it is possible to bond e.g. nonwoven materials to nonwoven materials, nonwoven materials to film materials, or film materials to film materials to form a multi-ply material.

The web-shaped material could also include a multi-ply material which is already laminated before being subject to the method for creating apertures with sealed edges. The lamination of the multi-ply material may then be enhanced by the creation of the melted regions surrounding the apertures. Also, a laminated material could form one ply which is connected to one or more additional plies by means of the proposed method.

In a particular embodiment, the web-shaped material as a whole includes at least one of polypropylene, polyethylene, and polyester.

In a particular embodiment, the horn and the anvil roller may be selected such that the width of the melted regions in the cross direction of the web is in the region 0.5-2.5 mm, in particular 0.6 to 2.0 mm. The width of the melted regions is to be understood to be the width of the regions including the apertures (i.e. the width of the aperture with the sealed edges). Hence, when measuring the width of a melted region in a finalized product, the measurement will take place in the machine direction and extend over an aperture. It will be understood that the apertures per se will have a width in the cross direction which is smaller than that of the melted region.

The proposed method is particularly suitable for creating relatively small, discrete apertures with sealed edges. Such apertures with their sealed edges may have substantially the same extension in the cross direction as in the machine direction, having e.g. circular or square shapes. The horn and the anvil roller may advantageously be selected such that the individual areas of the melted regions including the apertures are greater than 0.01 $mm^2$, e.g. in the range 0.2 $mm^2$ to 3.5 $mm^2$, in particular 0.3 $mm^2$ to 3 $mm^2$.

However, the extension of the melted regions in the machine direction perpendicular to the cross direction may vary considerably. For example, elongated melted regions including apertures may be created having a relatively large extension in the machine direction. In this case, the individual areas of the melted regions may e.g. be greater than 3 $mm^2$, in particular greater than 5 $mm^2$, most particularly greater than 10 $mm^2$.

Moreover, it will be understood that considerably larger apertures than those exemplified above may be created using the proposed method.

Generally, for the measurement of sizes or areas of the melted regions and/or the apertures, image analysis methods may be used.

The size of the melted regions may generally be controlled by the appearance of the anvil roller, which may be provided with protrusions having selected individual areas, which protrusions affect the formation of the melted regions. The melted regions will appear in the web-shaped material opposing the protrusions, as is known in the prior art.

In another aspect, there is provided a method for producing an absorbent article, wherein a web-shaped material is prepared to form a sheet in the article in an article forming process, and wherein the web-shaped material is apertured in-line with the article forming process and prior thereto in accordance with a method as described above. Hence, in this case the aperturing process form part of an in-line process for producing an absorbent article.

In such articles, the apertured web-shaped material may form any sheet which is typically apertured, such as a top-sheet, a transition sheet or the like.

In another aspect, there is provided a system for continuously creating apertures with sealed edges in a web shaped material including:

a rotational anvil roller a rotational ultrasonic horn, the anvil roller and the horn being arranged in an opposed relationship forming a nip through which a web residing on the anvil roller may be fed, for creation of melted regions in the web-shaped material, and means for controlling the rotational speed of the horn independently of the rotational speed of the anvil roller, enabling the system to be adjusted to create a stress in the web sufficient to create apertures in melted regions, resulting in a web being provided with apertures with melted edges.

Features and advantages as described above in relation to the method are equally applicable to the system.

BRIEF DESCRIPTION OF THE DRAWINGS

The invention will now be described in some more detail by reference to non-limiting examples and to the accompanying drawings wherein.

DETAILED DESCRIPTION OF PREFERRED EMBODIMENTS

Figure 1:
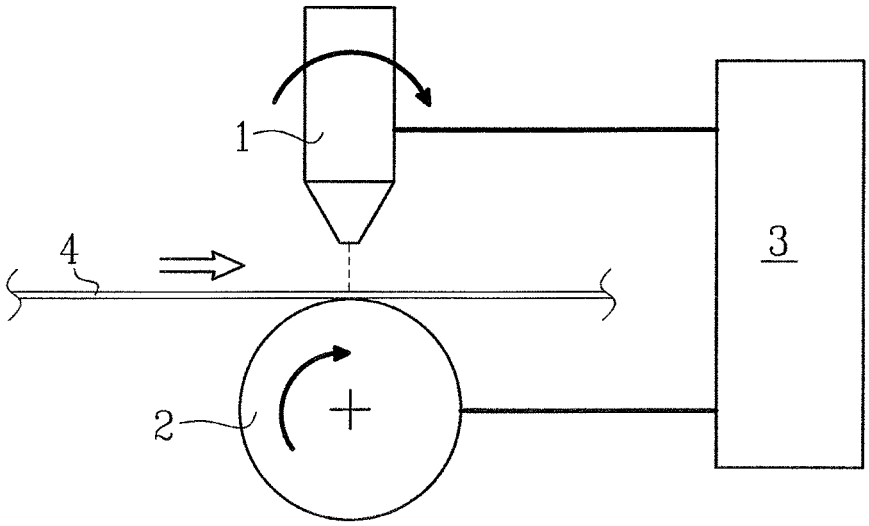
FIG. 1 illustrates an embodiment of a system for carrying out an embodiment of the method for creating apertures.

FIG. 1 illustrates schematically a system for carrying out the method for continuously forming apertures with melted edges in a web-shaped material.

A rotational anvil roller 2 and a rotational ultrasonic horn 1 are arranged to form a nip in which a web-shaped material 4 is apertured. The rotational speeds of the anvil roller 2 and the horn 1, respectively, are controlled by a controller 3. Advantageously, the controller 3 may keep the speed difference between the horn 1 and the anvil roller 2 constant, regardless of the speed of the anvil roller 2. The web-shaped material 4 is fed on the anvil roller 2, which is why the speed thereof will decide the feeding speed of the system.

If the system is arranged in-line with e.g. machinery for forming an absorbent article, then the speed of the anvil roller 2 will have to match the feeding speed of the absorbent article formation process. Accordingly, it is advantageous that the speed of the system is variable.

For the rotational anvil and the rotational ultrasonic horn, previously known technology may be used, such as described e.g. in EP 0 457 187. However, in prior art technology, rotational horns and anvils are generally controlled such that no speed difference appears between the horn and the anvil. The control of the rotational speeds of the horn and the anvil may be adapted as described herein using conventional automatic control engineering.

In the embodiment illustrated in FIG. 1, the web-shaped material 4 is directly fed into the nip between the ultrasonic horn 1 and the anvil roller 2. In the illustrated embodiment, the nip is a non-contact nip. If desired, the web-shaped material may be compressed in a pre-compression unit before feeding into the nip.

It shall be understood that, when the web-shaped material 4 includes several plies, the material for the separate plies may be fed from separate rollers and meet before the pre-compression unit (if present) or before being simultaneously fed into the nip between the horn 1 and the anvil roller 2.

In the illustrated embodiment, the rotational anvil roller 2 and the rotational horn 1 are illustrated as rotating in the same rotational directions (see the arrows). This is believed to be particularly advantageous in particular as it facilitates control of the units. However, the horn 1 and the anvil roller 2 may also rotate in different rotational directions.

The precise speed difference to use will vary depending e.g. on the material of the web-shaped material, its thickness, and the number of plies therein. However, the process for selecting the proper speed difference in a particular case is easily performed by a person skilled in the art. As the frequency of the ultrasonic horn of a conventional system is usually not selectable, but remains within about 20 kHz to 40 kHz, the person skilled in the art is bound to the pre-selected frequency.

The welding power of the horn may be adjusted to the highest power available before contact with the anvil roll appears. Contact with the anvil roll is generally not desired as it will lead to wear of the parts.

Once the welding power is set, the person skilled in the art may start the process with the selected web material, and vary the speed difference between the anvil and the horn until the desired apertures with melted edges result. The desired result, being the apertures with their melted edges, is easily verifiable by the person skilled in the art, which makes the setting of a correct speed difference easy. Generally, suitable speed differences are believed to be those as specified in the above.

Figure 2A:
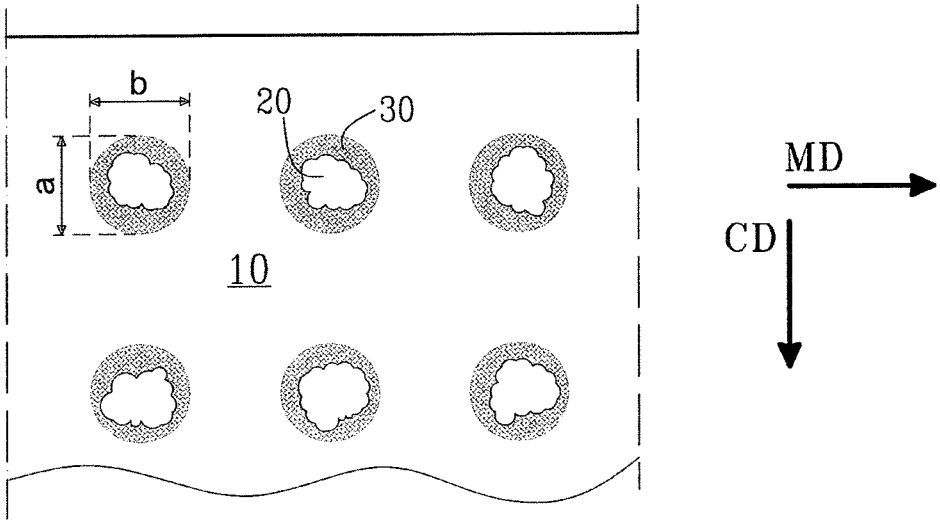
FIG. 2*a* illustrates an embodiment of an apertured web as obtained by an embodiment of a method in accordance with the invention.

FIG. 2*a* illustrates a portion of an embodiment of an apertured web as obtained by an embodiment of the proposed method. The web 10 is provided with apertures 20, each aperture being surrounded by a melted region 30 where the web material surrounding the aperture 20 is melted so as to form a seal around the aperture 20. Since the aperture 20 is created by stresses causing the initially integral melted region 30 to rupture, the precise borders of the actual aperture 20 may vary somewhat, although they will in general follow the contour of the melted region 30. The rupture is generally believed to involve some shattering of the material in the sealed. Accordingly, the resulting aperture is not only a melted region including a crack or slit. Rather, at least some of the melted material in the melted region is shattered and hence removed from the web, such that an aperture with sealed edges is formed.

In view of the above, it will be understood that, when the method is used to create a plurality of apertures with sealed regions, the apertures having the same dimensions, measurements of the sizes of the apertures 20 per se, as could be made by image analysis methods, may reveal slight variations from aperture to aperture.

The melted regions 30 will have a more uniform appearance, as created by the ultrasonic process. Their size could likewise be determined using image analysis methods. However, it will be understood that the difference in area between the melted region 30 and the aperture 20 will be relatively small, and moreover be approximately the same for different individual apertures 20. Accordingly, a measure of the dimensions of the melted regions including the apertures may be used for reflecting the dimensions of the apertures, and may in many practical applications be sufficient for serving the purpose of approximately determining the size of the apertures.

Hence, for practical purposes, it is proposed to use the dimensions of the melted regions 30 including the apertures 20 rather than the dimensions of the apertures 20 as a relative measure of the properties of the apertured web 1.

In FIG. 2*a*, the web 1 is provided with a number of discrete apertures 20. The width a of the melted region 30 including an aperture 20 (i.e. the width of the aperture with its sealed edges) as measured in the cross-direction CD of the web is approximately the same as the length b as measured in the machine direction MD of the web. In this case, the width a and the length b may be in the region 0.5-2.5 mm, in particular 0.6 to 2.0 mm. In other embodiments, the area of each discrete melted region 30 may be greater than 0.1 $mm^2$, in particular in the range 0.2 to 3.5 $mm^2$, most particularly 0.3 to 3 $mm^2$.

Figure 2B:
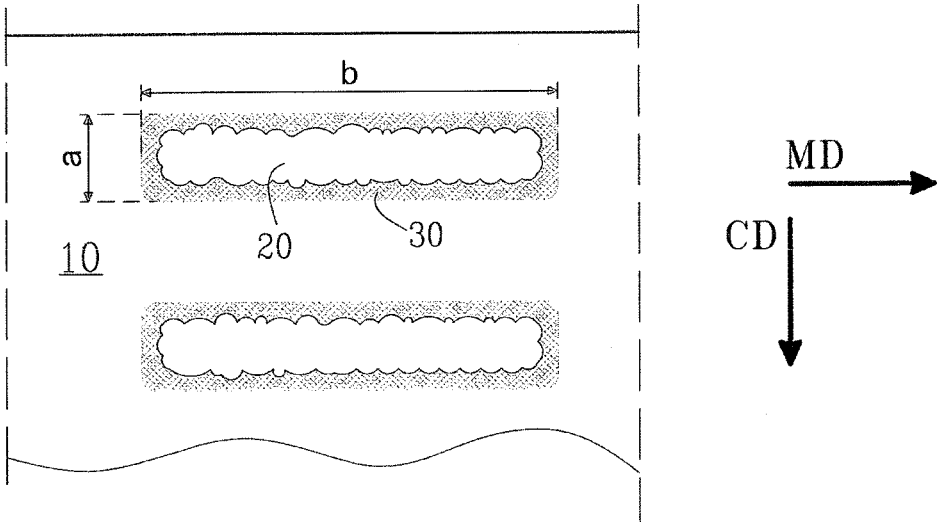
FIG. 2*b* illustrates another embodiment of an apertured web as obtained by an embodiment of a method in accordance with the invention

In FIG. 2*b*, the web 1 is likewise provided with a number of apertures 20. The width a of the melted region 30 including the aperture as measured in the cross-direction CD of the web is considerably smaller than the length b as measured in the machine direction of the web. For example, the length b may be more than twice the width a. The area of each melted region 30 may in this embodiment be greater than 3 $mm^2$, in particular greater than 5 $mm^2$, most particularly greater than 10 $mm^2$.

Both embodiments as described above are suitable for forming a multi-ply web, that is, two or more web shaped materials are laminated via the melted regions 30.

It will be understood, that the present invention may be varied within the scope of the appended claims. For example, the invention is not restricted to web shaped materials in the form of essentially continuous webs of material alone. Instead, it may also be used where the material consists of discrete items that are fed past an ultrasonic device. Moreover, the apertures need not extend continuously over the entire length of the web shaped material but may be applied e.g. only to selected regions of the web shaped material.

The invention claimed is:

1. A method for creating apertures with sealed edges in a web shaped material comprising:

feeding a web-shaped material through a nip between a rotational ultrasonic horn and a rotational anvil roller, so as to create melted regions in said web-shaped material, while the web-shaped material is residing on the anvil roller having a rotational speed, and controlling the rotational speed of the ultrasonic horn to a nonzero speed other than that of the anvil roller, such that a speed difference is created between the horn and the anvil roller, wherein the speed difference is selected such that a stress created in the web-shaped material acts to rupture the centers of the melted regions in the web-shaped material, whereby said apertures with sealed edges are created.

2. The method according to claim 1, further comprising controlling the rotational speed of the horn in relationship to the speed of the anvil roller, so as to maintain a controlled speed difference regardless of the speed of the anvil roller.

3. The method according to claim 1, wherein said web-shaped material comprises at least two separate plies, which are fed through the nip such that the at least two plies are laminated together via the melted edges of said apertures.

4. The method according to claim 3, wherein the web-shaped material comprises at least 4 separate plies which are laminated together via the melted edges of said apertures.

5. The method according to claim 1, wherein the difference in rotational speed between the anvil roller and the horn in relation to the rotational speed of the anvil roller ((speed roller−speed horn)/speed roller) is in the range of ±10-100% of the speed of the anvil roller.

6. The method according to claim 1, wherein the difference in rotational speed between the anvil roller and the horn is in the range of 20-300 m/min.

7. The method according to claim 1, wherein the rotational speed of the horn is in the range 5-500 m/min.

8. The method according to claim 1, wherein the total surface weight of the web-shaped material is between 10 gsm and 300 gsm.

9. The method according to claim 1, wherein the web-shaped material comprises at least one of polypropylene, polyethylene, and polyester.

10. The method according to claim 1, wherein the web-shaped material comprises at least one ply being formed from a nonwoven material, a film material, or a combination thereof.

* * * * *